US006104134A

United States Patent [19]

Kikuchihara et al.

[11] Patent Number: 6,104,134

[45] Date of Patent: Aug. 15, 2000

[54] FLUORESCENT LAMP

[75] Inventors: Kouji Kikuchihara; Tsuneyoshi Shibasaki; Ryuichi Suzuki; Hisataka Kondo; Masatoshi Chiba, all of Iwaki, Japan

[73] Assignee: Stanley Electric Co., Ltd., Tokyo, Japan

[21] Appl. No.: 09/136,453

[22] Filed: Aug. 19, 1998

[30] Foreign Application Priority Data

Aug. 20, 1997 [JP] Japan ..... 9-223517

[51] Int. Cl.[7] ..... H01J 1/36; H01J 1/88

[52] U.S. Cl. ..... 313/491; 313/632; 313/621

[58] Field of Search ..... 313/631, 632, 313/630, 491, 619, 622, 620, 621, 574

[56] References Cited

U.S. PATENT DOCUMENTS

| | | | |
|---|---|---|---|
| 2,403,184 | 7/1946 | Lemmers | 313/620 |
| 2,832,912 | 4/1958 | Lake | 313/491 |
| 4,518,897 | 5/1985 | Proud et al. | 313/632 |
| 4,780,645 | 10/1988 | Toho et al. | 313/606 |
| 4,904,900 | 2/1990 | Bouchard et al. | 313/491 |
| 5,027,030 | 6/1991 | Bouchard et al. | 313/620 |
| 5,218,269 | 6/1993 | Bouchard | 313/620 |

FOREIGN PATENT DOCUMENTS

| | | | |
|---|---|---|---|
| 0838 833 | 4/1998 | European Pat. Off. | H01J 61/30 |
| 02-57552 | 4/1990 | Japan | H01J 61/02 |

*Primary Examiner*—Michael H. Day
*Attorney, Agent, or Firm*—Morgan, Lewis & Bockius LLP

[57] ABSTRACT

A fluorescent lamp comprising a bulb, a fluorescent material coated on an internal surface of the bulb, a stem, a discharge chamber filled with gas and mercury, a thermal cathode filament coated with electron emitting material, lead wires passing air-tight through the stem and supporting the thermal cathode filament and an anode, where the anode is substantially rectangular with a thickness 1/16~3/16 of the longitudinal length of the thermal cathode filament and is substantially parallel to cathode filament in a cross-sectional view along an axis Z. The thermal cathode filament and the rectangular anode are arranged such that either the thermal cathode filament or the rectangular anode is in a rotated position relative to the other on a parallel flat surface within an angle range of 30–60 degrees. In this composition, the smaller discharge spot is obtained to improve thermal electron emission efficiency and efficiency of the fluorescent lamp. Additionally, the luminance of the fluorescent lamp does not greatly decrease and is sufficient for use even after the discharge spot passes the center point of the thermal cathode filament.

2 Claims, 3 Drawing Sheets

FLUORESCENT LAMP

This invention claims the benefit of Japanese Patent Application No. 09-223517, filed on Aug. 20, 1997, which is hereby incorporated by reference.

BACKGROUND OF THE INVENTION

The present invention relates to a fluorescent lamp used as a signal light, and more particularly, to a single-ended subminiature fluorescent lamp in which power supply terminals are arranged on only one end of a bulb. The bulb is shaped as a typical halogen lamp used as a signal light.

FIG. 4 illustrates a cross-sectional view along the lamp axis Z of a conventional fluorescent lamp 90. FIG. 5 provides another cross-sectional view of the lamp along a surface including the B—B line of FIG. 4. The conventional fluorescent lamp 90 comprises a bulb 94 with fluorescent material 94*a* coated on an internal surface of the bulb 94, a stem 91, a discharge chamber 94*b* filled with gas and mercury, lead wires 91*a*, 91*a'*, 91*a"* passing air-tightly through the stem 91, a thermal cathode filament 92 coated with electron emitting material 92*a* and supported by the lead wires 91*a* and 91*a'*, and a ring-like anode 93 supported by the lead wire 91*a"*. To illuminate the conventional fluorescent lamp 90, a DC voltage of 5 V is first applied between the lead wire 91*a* and the lead wire 91*a"* such that thermal electrons are emitted. A DC voltage of 24V is then applied between the thermal cathode filament 92 and the ring-like anode 93, which directs the thermal electrons emitted from the thermal cathode filament 92 to the ring-like anode 93 such that discharge starts, thereby exciting fluorescent material 94*a* to emit light.

The conventional fluorescent lamp 90 has several problems. First, converting efficiency from wattage to luminance of the conventional fluorescent lamp 90 is approximately 3.7 lm/W, which is enough to use as a signal light, but insufficient for use as a backlight of a liquid crystal display. Second, as shown in FIG. 6, although the discharge should occur between the ring-like anode 93 and a grounded end S of the thermal cathode filament 92, a discharge spot P on the grounded end S moves towards a thermal cathode end U on a positive side as time passes, due to deterioration of the electron emitting material 92*a*. When a DC voltage of 5 V is applied to the thermal cathode filament 92, the discharge spot P on the thermal cathode filament 92 moves to the center point T of the thermal cathode filament 92, which has a higher voltage by approximately 2.5V than at the grounded cathode end S. In other words, the electric potential between the thermal cathode filament 92 and the ring-like anode 93 decreases by approximately 2.5 V, thereby decreasing discharge current and the luminance of the subminiature fluorescent lamp 90. When the discharge spot P passes the center point T of the thermal cathode filament 92 toward the thermal cathode end U on the positive side, the luminance of the fluorescent lamp 90 further decreases, as shown in line BO of FIG. 3. This is because the discharge distance between the discharge spot P and the ring-like anode 93 increases in spite of the voltage decrease between the thermal cathode filament 92 and the ring-like anode 93.

SUMMARY OF THE INVENTION

The present invention is directed to a fluorescent lamp that substantially obviates one or more of the above problems due to the limitations and disadvantages of the related art.

An object of the invention is to provide a fluorescent lamp having higher luminance sufficient for use as a backlight of a liquid crystal display.

Another object of the invention is to provide a fluorescent lamp that is capable of maintaining high luminance even after the discharge spot passes the center point of the thermal cathode filament.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

According to the present invention, the above objects are achieved by providing a fluorescent lamp comprising a thermal cathode filament coated with electron emitting material, a substantially rectangular anode with thickness of 1/16~3/16 of the longitudinal length of the thermal cathode filament, in which the thermal cathode and one side of the anode are rotatedly positioned from each other within an angle range of 30–60 degrees on a parallel flat surface.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
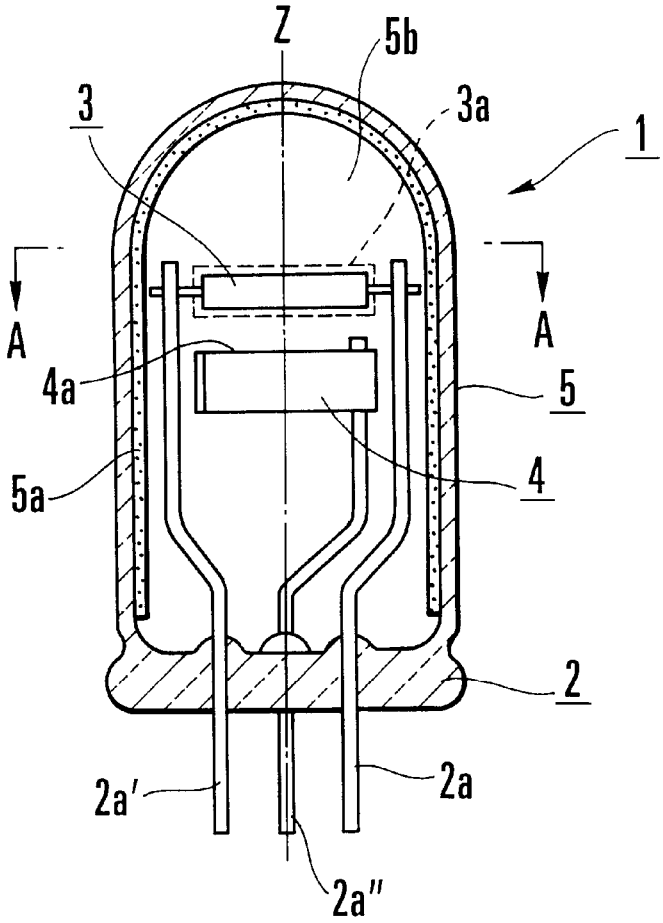
FIG. 1 illustrates a cross-sectional view along a lamp axis Z of the preferred embodiment of the present invention.
Figure 2:
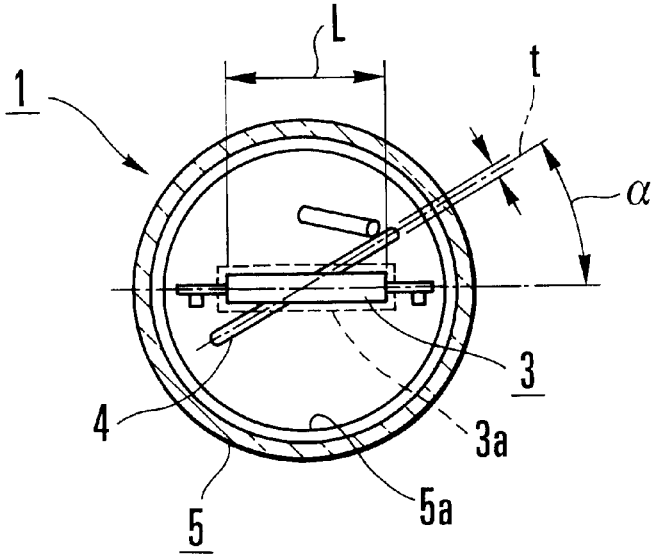
FIG. 2 illustrates a cross-sectional view along A—A line in FIG. 1 of the preferred embodiment of the present invention.

FIG. 1 provides a cross-sectional view along a lamp axis Z of the preferred embodiment of the present invention, and FIG. 2 provides a cross-sectional view along A—A line in FIG. 1.

Figure 4:
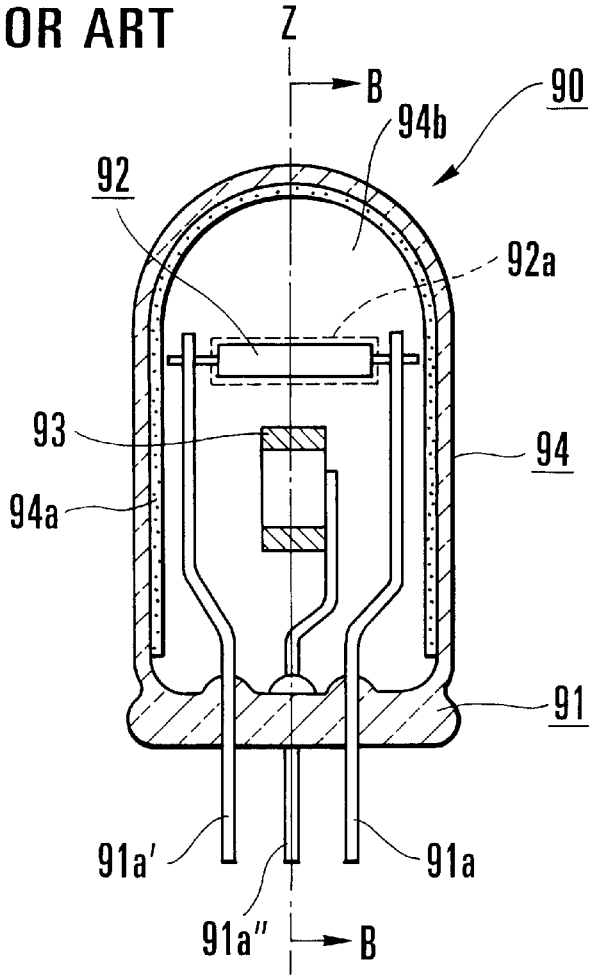
FIG. 4 PRIOR ART
FIG. 4 illustrates a cross-sectional view along a lamp axis Z of a conventional fluorescent lamp.
Figure 5:
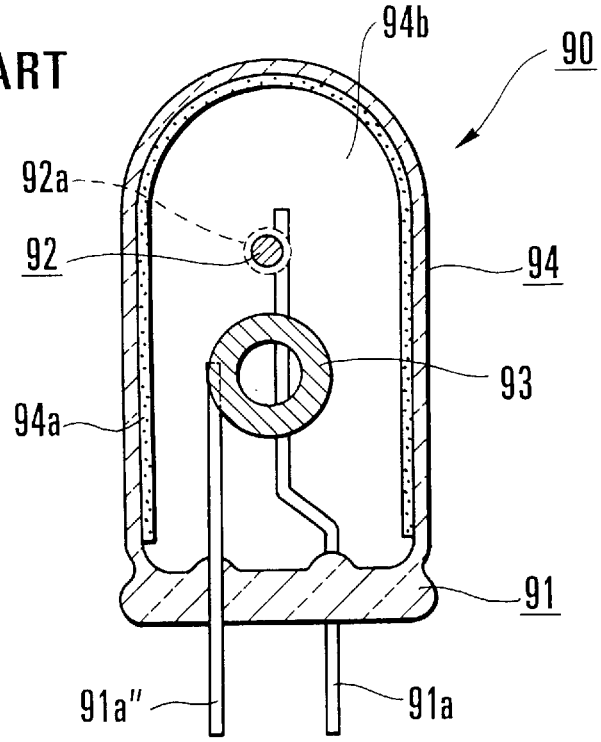
FIG. 5 PRIOR ART
FIG. 5 illustrates a cross-sectional view along B—B line in FIG. 4 of the conventional fluorescent lamp.
Figure 6:
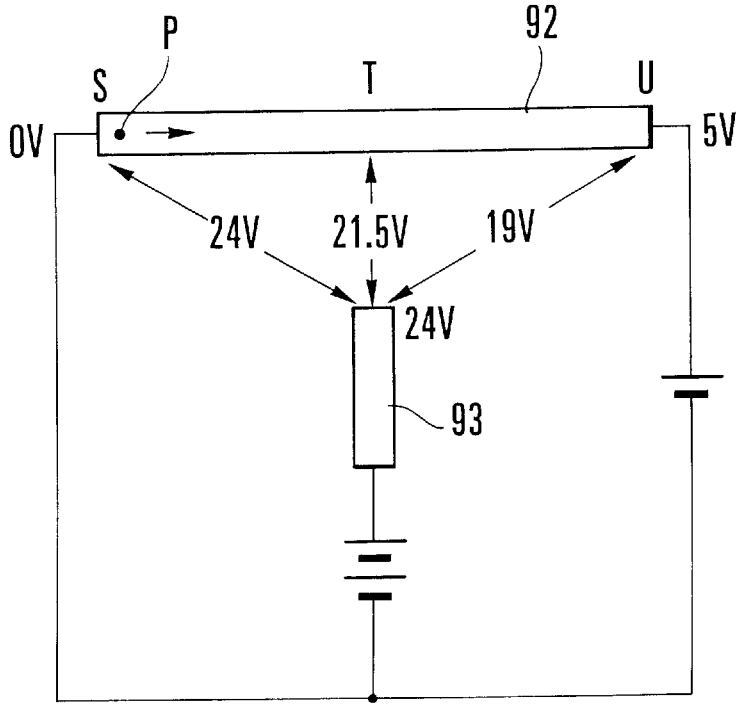
FIG. 6 is a diagram showing position shift of a discharge spot on a thermal cathode filament of a conventional fluorescent lamp.

The fluorescent lamp 1 comprises a bulb 5, fluorescent material 5*a* coated on an internal surface of the bulb 5, a stem 2, a discharge chamber 5*b* filled with gas and mercury, lead wires 2*a*, 2*a'*, 2*a"*passing air-tight through the stem 2, a thermal cathode filament 3 coated with electron emitting material 3*a* and supported by the lead wires 2*a* and 2*a'*, and a rectangular anode 4 supported by the lead wire 2*a"*. In this embodiment, the anode 4 is substantially rectangular, and thickness of the rectangular anode 4 is within a range of 1/16~3/16 of the longitudinal length of the thermal cathode filament 3, which is approximately half the thickness of the conventional anode. The thickness of the conventional ring-like anode 93 in FIG. 4 is within a range of 5/16~10/16 of the longitudinal length of the thermal cathode filament 92.

The thermal cathode 3 and one side 4*a* of the rectangular anode 4 are arranged in a rotated position relative to each other within an angle range of 30–60 degrees on a parallel flat surface. As shown in FIG. 1, one side 4*a* of the rectangular anode 4 faces and is parallel to the thermal cathode filament 3 in a cross-sectional view along a longitudinal length of the rectangular anode 4. The center of a longitudinal length L of the thermal cathode filament 3 passes through the lamp axis Z. As shown in FIG. 2, in a cross-sectional view along A—A line in FIG. 1, the A—A line crosses the lamp axis Z at a right angle. From this perspective, the angle $\alpha$ between the side 4*a* and the thermal cathode filament 3 is within a range of 30–60 degrees, as compared to approximately 90 degrees in the conventional fluorescent lamp.

Figure 3:
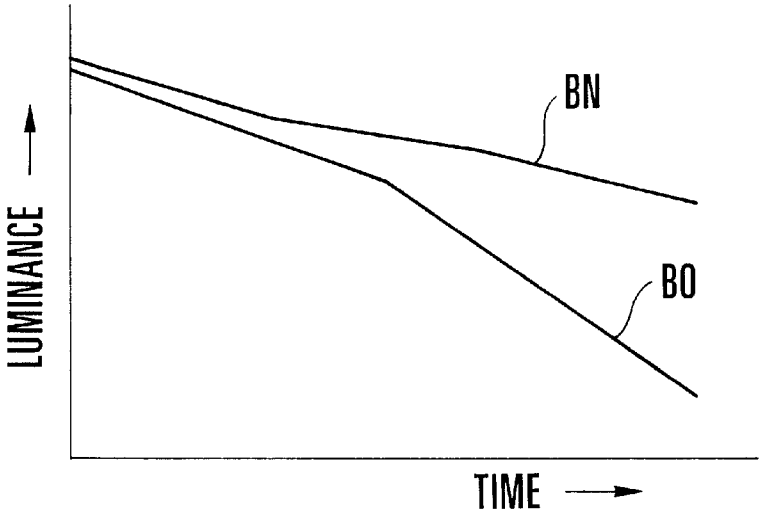
FIG. 3 is a graph showing luminance changes of the preferred embodiment of the present invention and the conventional lamp as a function of time.

The operational advantages of the fluorescent lamp 1 according to the preferred embodiment of the present invention will now be described. First, since the thickness of the rectangular anode 4 is smaller than in the conventional lamp, a stronger electric field is applied. Accordingly, a smaller discharge spot is obtained on the thermal cathode filament 3 and the temperature of the cathode spot increases, improving thermal electron emission efficiency. Since thermal electron emission occurs in a larger quantity, ultraviolet rays are also emitted in larger quantities than in the conventional florescent lamp. Thus, a brighter fluorescent lamp with improved efficiency is provided. Second, since the rectangular anode 4 is substantially parallel to the thermal cathode filament 3, as the discharge spot P on the thermal cathode 3 moves, as time passes, there is less distance from the grounded end S to the thermal cathode end U on the positive side than in the conventional lamp. Accordingly, as shown by line BN of FIG. 3, the luminance of the fluorescent lamp 1 more gradually decreases and keeps high luminance after the discharge spot passes the center of the thermal cathode filament, as compared with the line BO which shows luminance change of the conventional fluorescent lamp 90.

It will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A fluorescent lamp comprising:

a bulb;

fluorescent material coated on an internal surface of the bulb;

a stem;

a discharge chamber filled with gas and mercury;

a thermal cathode filament coated with electron emitting material;

lead wires supporting the thermal cathode filament;

and an anode, wherein the anode is substantially rectangular with a thickness of 1/16~3/16 of the longitudinal length of the thermal cathode filament, and is substantially parallel to the thermal cathode filament in a cross-sectional view along an axis Z.

2. The fluorescent lamp according to claim 1, wherein the thermal cathode filament and the rectangular anode are arranged in a rotated position relative to each other within an angle range of 30–60 degrees on a parallel flat surface.

* * * * *